US005216907A

United States Patent [19]

Ullmann

[11] Patent Number: 5,216,907

[45] Date of Patent: Jun. 8, 1993

[54] DEVICE FOR LOCKING A COIN CONTROL MECHANISM AND INSERT INTO THE INTERIOR OF A CABINET OF A NEWSPAPER RACK

[75] Inventor: Ralph J. Ullmann, Shiner, Tex.

[73] Assignee: Kaspar Wire Works, Inc., Shiner, Tex.

[21] Appl. No.: 906,680

[22] Filed: Jun. 30, 1992

Related U.S. Application Data

[63] Continuation-in-part of Ser. No. 834,431, Feb. 13, 1992.

[51] Int. Cl.[5] ..... B65D 55/16

[52] U.S. Cl. ..... 70/159; 194/350; 232/15; 70/63

[58] Field of Search ..... 194/350; 221/154, 97; 70/54-56, DIG. 41, 159, 62-63; 232/1 C, 16, 17, 1 D, 15

[56] References Cited

U.S. PATENT DOCUMENTS

| | | | |
|---|---|---|---|
| 2,716,882 | 9/1955 | Gill et al. | 70/159 |
| 3,353,743 | 11/1967 | Amundsen | 232/15 |
| 3,851,942 | 12/1974 | Clay et al. | 232/15 |
| 4,106,609 | 8/1978 | Kaspar | 22/154 |
| 4,424,892 | 1/1984 | Marcroft | 194/346 |
| 4,718,532 | 1/1988 | Chalabian | 49/386 |

*Primary Examiner*—Peter M. Cuomo
*Assistant Examiner*—Darnell Boucher
*Attorney, Agent, or Firm*—Gunn, Lee & Miller

[57] ABSTRACT

A device for locking a coin control mechanism and insert into the interior of the housing of cabinet of a newspaper rack, the device comprising a cross bar (30) permanently mounted across the housing front opening (22) on which there is attached a blade receipt member (32) or in which a blade receipt slot (33) is located. An insert (38) consisting of a metal perimeter (40) having an insert cross member (52) extending from an upper insert brace (42) to a lower insert brace (46) is connected to pivot cams (36) attached to or near a lower edge (24) of the housing opening. The insert cross member (52) has an insert bracket (56) attached thereto which is generally L-shaped, having an attachment leg (58) for attaching the insert bracket (56) to the insert cross member (52) and a lock receiving leg (60). The insert (38) attaches to the pivot cams (36), and is dimensioned such that the perimeter (40) fits snugly against the perimeter of the front opening (22) of the cabinet. After attaching to the pivot cams (36), the insert (38) is rotated upward with the lock receiving leg (60) of the insert cross member (52) passing through the opening of the housing cross bar (30). The coin control mechanism of the newspaper cabinet is attached to a coin mechanism mounting plate (64), the walls having an L-shaped bracket (56) for mounting to the side wall (76) of the housing mechanism, and located such that the L-shaped bracket (56) aligns with the lock receiving leg (60) of the insert locking bracket (56). A padlock is inserted through the hole of the lock receiving legs of both L-shaped brackets to lock the insert and coin control mechanism to the cabinet.

4 Claims, 1 Drawing Sheet

DEVICE FOR LOCKING A COIN CONTROL MECHANISM AND INSERT INTO THE INTERIOR OF A CABINET OF A NEWSPAPER RACK

This is a Continuation-in-Part of copending application(s) Ser. No. 07/834,431 filed on Feb. 13, 1992 pending

FIELD OF THE INVENTION

The device of the present invention relates to a locking bracket, more specifically to a locking bracket for locking an insert and coin mechanism into the interior of a cabinet of a newspaper vending machine.

BACKGROUND

Newspaper racks of the type having coin control, door-accessible mechanisms are frequently subject to vandalism. More particularly, vandals often attempt to remove the coin control mechanism from the newspaper rack so that they can later, at a concealed location, break into the coin control mechanism to gain access to the vault containing the coins. The coin control mechanism, however, must be easily removable from the cabinet for servicing, adjustment, repair and the like. Thus, the coin control mechanism of a newspaper vending machine is frequently removably attached to a plate on the cabinet and then locked in place with a padlock. However, the prior art discloses only padlocks that are attached to the outside of the newspaper cabinet rather than being enclosed within the walls of the cabinet. This type of padlock is more accessible to thieves with bolt cutters and is also exposed to the weather. Some padlock-attached coin control mechanisms mounted to the exterior of the newspaper cabinet have a heavy metal apron or shroud as part of the locking assembly, thus making it more difficult for a thief to break the lock. However, even this is not fool proof and the apron or shroud does not fully weather-enclose the padlock from the elements.

Thus, what is needed is a means to lock, with a padlock, a coin control mechanism for a newspaper vending machine such that the lock is enclosed within the walls of the cabinet, making it less accessible to thieves and more protected from the elements.

OBJECTS OF THE INVENTION

The object of the present invention is to provide for a lock receiving bracket which will lock a coin control mechanism to the newspaper cabinet while enclosing the lock within the walls of the cabinet.

SUMMARY OF THE INVENTION

A device for locking a coin control mechanism and insert into the interior of the housing of a cabinet of a newspaper rack, the device comprising a cross bar permanently mounted across the housing front opening on which there is attached a blade receipt member or in which a blade receipt slot is located. An insert consisting of a metal perimeter having an insert cross member extending from an upper insert brace to a lower insert brace is connected to pivot cams attached to or near a lower edge of the housing opening. The insert cross member has an insert bracket attached thereto which is generally L-shaped, having an attachment leg for attaching the insert bracket to the insert cross member and a lock receiving leg. The insert attaches to the pivot cams, and is dimension to such that the perimeter fits snugly against the perimeter of the front opening of the cabinet. After attaching to the pivot cams the insert is rotated upward with the lock receiving leg of the insert cross member passing through the opening of the housing cross bar (30). The coin control mechanism of the newspaper cabinet is attached to a coin mechanism mounting plate, the walls having an L-shaped bracket for mounting to the side wall of the housing mechanism, and located such that the L-shaped bracket aligns with the lock receiving leg of the insert locking bracket. A padlock is inserted through the hole of the lock receiving legs of both L-shaped brackets to lock the insert and coin control mechanism to the cabinet.

DETAILED DESCRIPTION OF THE PREFERRED ENVIRONMENT

Figure 1:
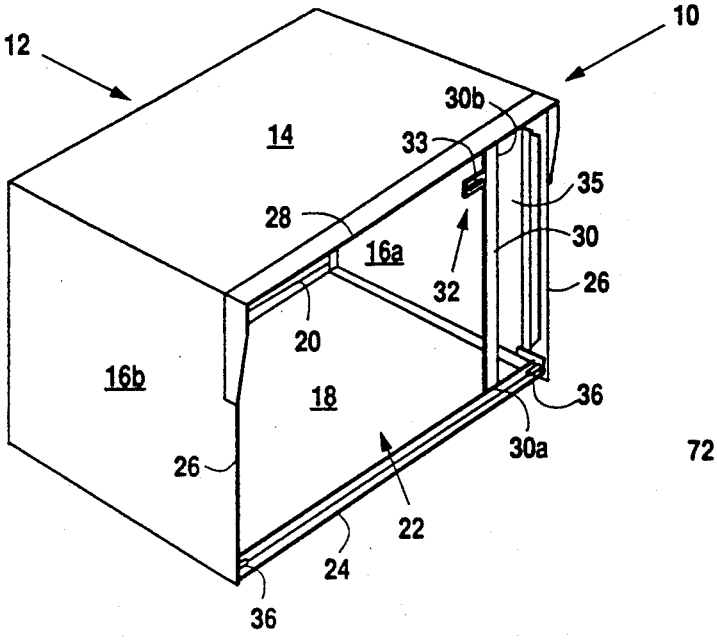
FIG. 1 is a perspective view of the housing of the cabinet of the present invention illustrating the housing cross bar with a blade receipt member thereon.
Figure 1A:
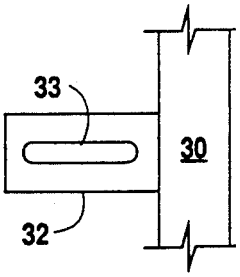
FIG. 1*a* is an illustration of blade receipt member (32) of the present invention as attached to housing cross member (30).
Figure 2:
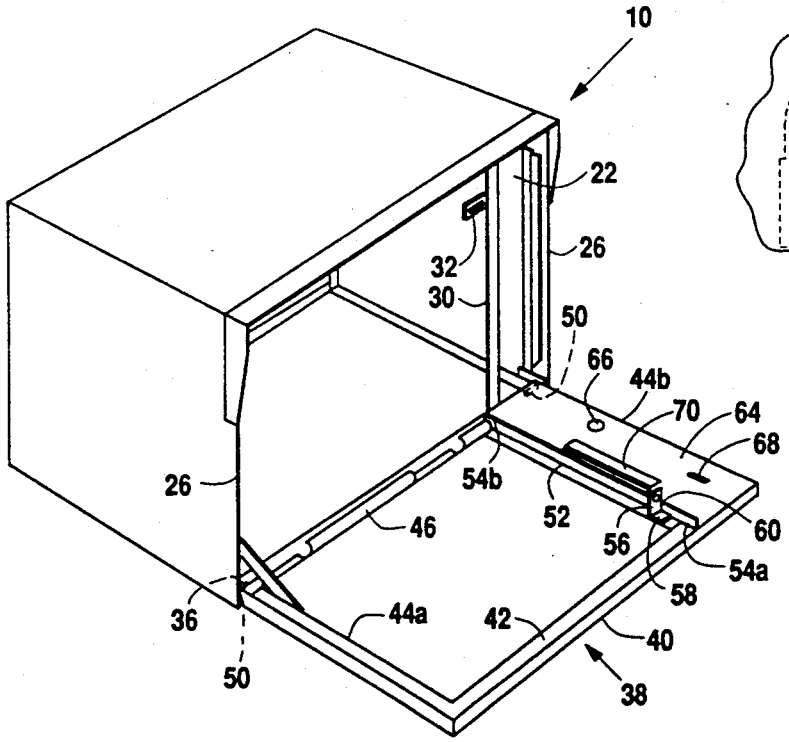
FIG. 2 is a partial perspective view of the housing of the cabinet of the present invention illustrating the pivoting insert attached to the pivot cams along the lower edge of the front opening of the housing.
Figure 5:
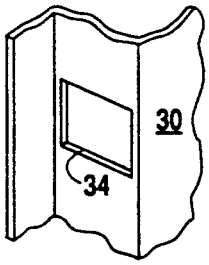
FIG. 5 is an alternate preferred embodiment of the present invention wherein both the insert cross member and the housing cross bar are U-shaped with the lock receiving leg of the insert locking bracket projecting through a slot in the U-shaped housing cross bar and aligning with the lock receiving leg of the mechanism bracket in the same manner as illustrated in FIG. 4.

FIGS. 1 and 2 illustrate a newspaper cabinet (10) of the present invention as comprising two main components, a housing (12) (FIG. 1) and a pivoting insert (38) (seen attached to lower edge (24) of housing (12) in FIG. 2). The housing (12) has a top surface (14), side walls (16*a*) and (16*b*), bottom surface (18), and back wall (20). Thus housing (12) is comprised of a generally rectangular, walled enclosure with front opening (22), the front opening (22) having lower edge (24), side edges (26), and upper edge (28). Extending across front opening (22) is rigid housing cross bar (30) having removed ends (30*a*) and (30*b*) attached to walls of housing (12). As can be seen in FIGS. 1 and 2, housing cross bar (30) extends across front opening (22) and parallel with side edges (26). Housing cross bar (30) has, close to removed end (30*b*), blade receipt member (32) with blade receipt slot (33) therein (see FIG. 1*a*) or in the alternative, as illustrated in FIG. 5, slot means (34). In addition, housing (12) has along side edges (26) and near lower edge (24), pivot cams (36). Alternately, pivot cams (36) may be attached to lower edge (24) near side edges (26).

Turning now to FIG. 2, illustrating housing (12) with pivoting insert (38) attached at cams (36), it can be seen that front opening (22) is dimensioned to receive flush with the edges thereof, pivoting insert (38). More particularly, pivoting insert (38) is comprised of a rigid metal perimeter (40) which is made up of upper insert brace (42), side insert braces (44*a*) and (44*b*), and lower insert brace (46). Along lower insert brace (46) and near the junction with side insert braces (44*a*) and (44*b*), are latches (50) designed to engage pivot cams (36) to allow lower insert brace (46) to lay flush against or near lower edge (24) and to allow pivoting insert (38) to rotate upwards such that upper insert brace (42) lies generally flush against upper edge (28).

Pivoting insert (38) has insert cross member (52) which is comprised of a rigid bar-shaped member with ends (54*a*) and (54*b*) attached to upper insert brace (42) and lower insert brace (46), respectively. Insert cross member (52) has on an inner face thereof, insert locking bracket (56). Insert locking bracket (56) is comprised of mounting leg (58) and lock receiving leg (60) with hole (62) therein. As can be seen in FIG. 2, insert locking bracket (56) is mounted to insert cross member (52) flush with the surface of mounting leg (58). Being generally L-shaped, insert locking (56) bracket has lock receiving leg (60) jutting out generally perpendicular from the inner surface of insert cross member (52) and is positioned along the inner surface of insert cross member (52) such that when pivoting insert (38), with latches (50) engaged with pivot cams (36), is rotated upward, lock receiving leg (60) slips through slot (33) of blade receipt member (32) or slot (34) (FIG. 5) of housing cross bar (30) (alternate preferred embodiment).

As can be seen in FIG. 2, pivoting insert (38) has mounted thereon coin mechanism mounting panel (64). Coin mechanism mounting panel (64) has access hole (66) and coin slot (68) therethrough. In addition, the rear surface (surface facing the inside of housing (12)) has mechanism mounting sleeve member (70) thereon for slidably or releasably and non-lockingly attaching the coin-control mechanism of the present invention to coin mechanism mounting panel (64).

Figure 3:
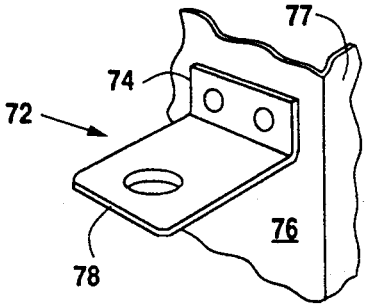
FIG. 3 is a view of the mechanism bracket with the mounting leg mounted to the side wall of the mechanism housing and the lock receiving leg projecting generally perpendicular therefrom.

FIG. 3 illustrates mechanism bracket (72) having mounting leg (74) attached to side wall (76) of the coin-control mechanism housing (77). As can been seen in FIG. 3, lock receiving leg (78) of mechanism bracket (72) juts out approximately perpendicular from mounting leg (74) and thus perpendicular from side wall (76). Both insert locking bracket (56) and mechanism bracket (72) should be rigidly and permanently attached to insert cross member (52) and side wall of mechanism housing (76), respectively, by means such as spot welding.

Figure 4:
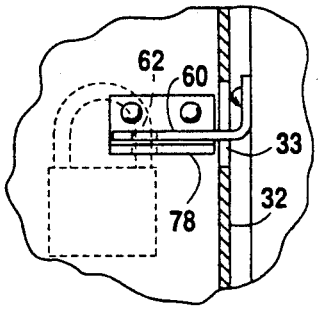
FIG. 4 is a perspective view of the locking mechanism of the present invention illustrating the engagement of the lock receiving legs of the insert bracket and the mechanism bracket and how the lock receiving leg of the insert locking bracket passes through the blade receipt member of the housing bar to lock the housing mechanism to the housing bar and to the insert.

FIG. 4 illustrates the engagement of lock receiving leg (60) in alignment with lock receiving leg (78) of side wall (76) of coin control mechanism (77), lock receiving leg (60) having first passed through either blade receipt hole (33) of blade receipt member (32) or through clearance slot (34) of housing cross bar (30). With the two lock receiving legs thus aligned, the hasp of a padlock (shown in dashed lines in FIG. 4) can be passed therethrough and lockingly inserted into the body of the padlock. This will lock the housing of the mechanism to the insert and the cabinet, thus making it difficult for thieves to remove same and thus providing protection for the lock from the elements.

Thus a device for locking a coin control mechanism and insert into the interior of the housing of a cabinet of a newspaper rack, the device comprising a cross bar permanently mounted across the housing front opening on which there is attached a blade receipt member or in which a blade receipt slot is located. An insert consisting of a metal perimeter having an insert cross member extending from an upper insert brace to a lower insert brace is connected to pivot cams attached to or near a lower edge of the housing opening. The insert cross member has an insert bracket attached thereto which is generally L-shaped, having an attachment leg for attaching the insert bracket to the insert cross member and a lock receiving leg. The insert attaches to the pivot cams, and is dimension to such that the perimeter fits snugly against the perimeter of the front opening of the cabinet. After attaching to the pivot cams the insert is rotated upward with the lock receiving leg of the insert cross member passing through the opening of the housing cross bar (30). The coin control mechanism of the newspaper cabinet is attached to a coin mechanism mounting plate, the walls having an L-shaped bracket for mounting to the side wall of the housing mechanism, and located such that the L-shaped bracket aligns with the lock receiving leg of the insert locking bracket. A padlock is inserted through the hole of the lock receiving legs of both L-shaped brackets to lock the insert and coin control mechanism to the cabinet.

Terms such as "left", "right", "up", "down", "bottom", "top", "front", "back", "in", "out" and the like are applicable to the embodiment shown and described in conjunction with the drawings. These terms are merely for the purposes of description and do not necessarily apply to the position or manner in which the invention may be constructed or used.

Although the invention has been described in connection with the preferred embodiment, it is not intended to limit the invention to a particular form set forth, but on the contrary, it is intended to cover such alternatives, modifications, and equivalents as may be included within the spirit and the scope of the invention as defined by the appended claims.

I claim:

1. A door-accessible newspaper rack operated by a coin controlled mechanism and having a locking mechanism located within the newspaper rack, the locking mechanism for receiving the hasp of a padlock, the newspaper rack comprising:

a generally rectangular housing having a top wall, a bottom wall, two side walls and a back wall, the walls defining a front opening having a top edge, a bottom edge, and two side edges;

a frame insert mountable into the front opening of said housing, the frame insert having a rigid perimeter and having a cross brace thereon;

first locking means having a blade thereon, the blade having a padlock receiving hole therein, said first locking means permanently and rigidly mounted to the cross-brace of said frame insert;

a housing cross bar mounted to and extending from the top edge to the bottom edge of said housing and having receipt means thereon for receipt of the blade of said first locking means therethrough; and a second locking means attached to the coin control mechanism, the second locking means having a blade thereon, the blade having a padlock receiving hole therein, said second locking means dimensioned and located adjacent said first locking means when said insert frame is insertably mounted into the opening of said housing and when the blade of said first locking means is projecting through the receipt means of said housing bar;

wherein a padlock hasp insertable through the holes of the blade of said first locking means and said second locking means helps prevent the theft of the coin control mechanism from the cabinet.

2. The device of claim 1 wherein the receipt means of said housing cross bar comprises walls defining a slot within said housing cross bar, the slot dimensioned to allow the passage of the blade of said first locking means.

3. The device of claim 1 wherein the receipt means of said housing cross bar comprises an elongated member integral with and extending generally perpendicular from said housing cross bar, the elongated member having walls defining a slot therein, the slot dimensioned to allow the passage of the blade of said first locking means.

4. The device of claim 1 wherein said second locking means comprises an L-shaped bracket, one leg of the L-shaped bracket for securing to the side wall of the coin control mechanism, the other leg of the L-shaped bracket being the blade with the padlock receiving hole therein.

* * * * *